United States Patent [19]

Finger et al.

[11] 4,007,712

[45] Feb. 15, 1977

[54] WATER HEATER

[75] Inventors: John F. Finger; Merle E. Pochop, both of Beresford, S. Dak.

[73] Assignee: Sioux Steam Cleaner Corporation, Beresford, S. Dak.

[22] Filed: Mar. 3, 1976

[21] Appl. No.: 663,613

[52] U.S. Cl. ..... 122/250 R; 110/98 R; 122/510

[51] Int. Cl.[2] ..... F22B 27/08; F23M 9/06

[58] Field of Search ..... 122/248, 249, 250 R, 122/510; 110/97 R, 98 R

[56] References Cited

UNITED STATES PATENTS

| | | | |
|---|---|---|---|
| 2,012,216 | 8/1935 | Baumann | 122/250 |
| 2,576,988 | 12/1951 | Arant | 122/250 |
| 2,633,108 | 3/1953 | Sterick | 122/250 |

*Primary Examiner*—Kenneth W. Sprague
*Attorney, Agent, or Firm*—Merchant, Gould, Smith, Edell, Welter & Schmidt

[57] ABSTRACT

A generally cylindrical housing containing a burner underlying a fluid conduit formed to provide a plurality of interconnected concentric helical coils, the outermost coil having a lower end portion projection below the lower ends of the inner coils. A reticulate baffle, in underlying engagement with the lower end of an inner coil, cooperates with the lower end portion of the outermost coil to define a combustion chamber, the baffle permitting flow of gases of combustion upwardly therethrough but retaining most of the burner flame within the combustion chamber. The fluid conduit and its mounting structure are arranged for easy removal from the housing and replacement therein.

9 Claims, 5 Drawing Figures

WATER HEATER

SUMMARY OF THE INVENTION

The present invention is in the nature of an apparatus for heating water to provide a supply of hot water or steam for various uses, and comprises a housing including a base portion, a generally cylindrical body portion and an upper end member which defines an opening for removal of gases of combustion. A burner is disposed at the base portion and is disposed to direct a combustion flame upwardly in the housing. A rigid fluid conduit in the housing is formed to provide an interconnected plurality of concentric helical coils including an outer coil of relatively long axial length and an inner second coil of relatively shorter axial length within the outer coil, the second coil having an upper end disposed near the upper end of the outer coil. Means is provided for supporting said conduit above the level of the burner. A generally horizontally disposed reticulate baffle has a diameter slightly less than the inner diameter of the outer coil, and means is provided for supporting the baffle within the outer coil at the lower end of the second coil. The baffle and lower end portion of the outer coil cooperate with the burner to define a combustion chamber, the baffle being operative to permit flow of gases of combustion upwardly therethrough while retaining the burner flame within the combustion chamber, to provide for a more thorough consumption of the combustion fuel than heretofore obtained.

DETAILED DESCRIPTION OF THE PREFERRED EMBODIMENT

Figure 1:
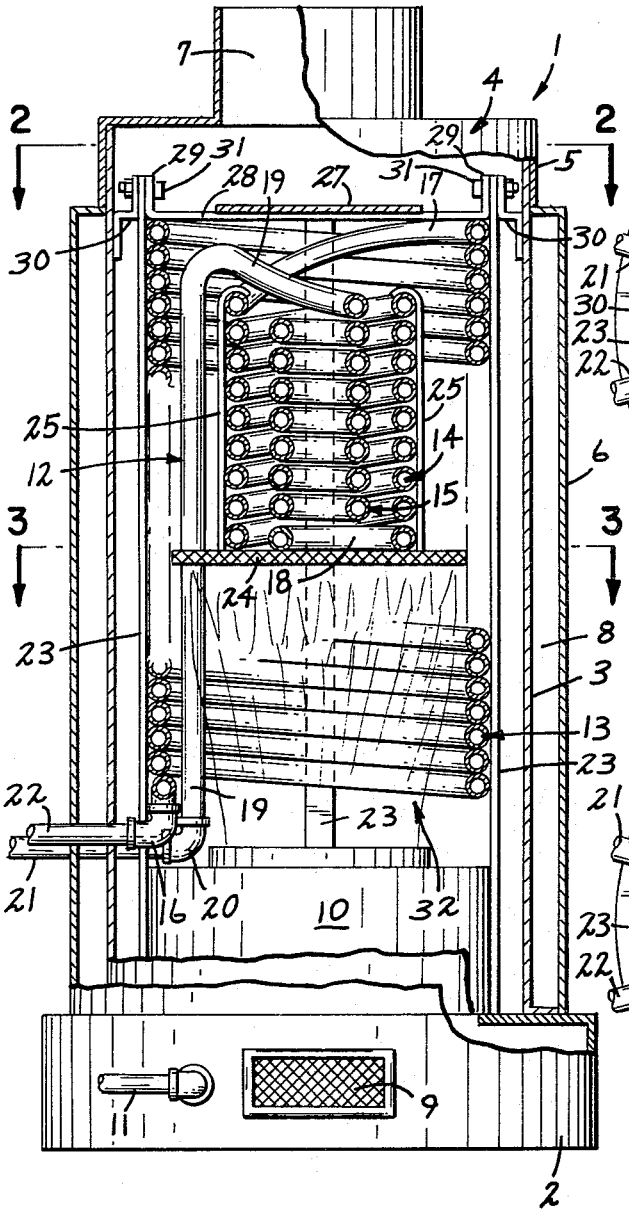
FIG. 1 is a view in side elevation of a water heater produced in accordance with the invention, some parts being broken away and some parts being shown in section.
Figure 2:
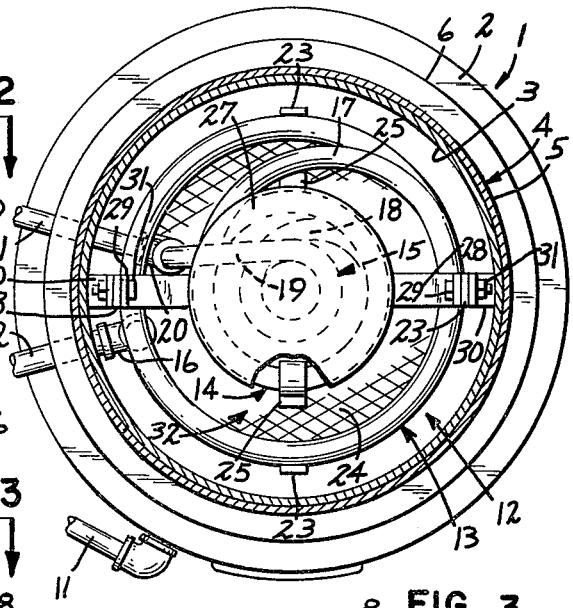
FIGS. 2 and 3 are transverse sections taken on the lines 2—2 and 3—3 respectively of FIG. 1.
Figure 3:
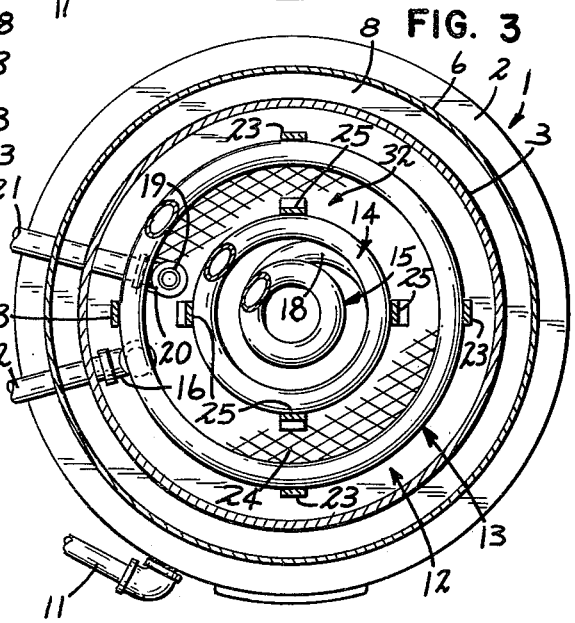
Figure 5:
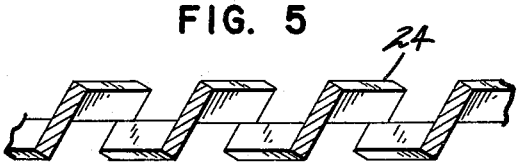
FIG. 5 is a further enlarged fragmentary section taken on the line 5—5 of FIG. 4.
Figure 4:
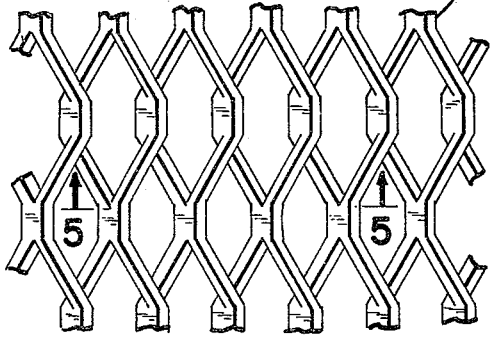
FIG. 4 is a fragmentary view in plan of the reticulate baffle of this invention, on an enlarged scale.

An upright generally cylindrical housing, indicated generally at 1, comprises a base portion 2, a cylindrical body 3, and an upper end member 4 which is provided with a depending flange 5 that encompasses the upper end of the body 3 and rests upon the upper inturned end of an outer jacket 6, the upper end member defining an axial opening 7 for removal of gases of combustion from the interior of the housing 1. The body 3 and jacket 6 cooperate to define an annular chamber 8 which, if desired, may be filled with suitable insulating material. Preferably, the base portion 2 may be provided with means for admitting combustion air to the interior of the housing 1, such as an opening 9.

A burner 10 is centrally mounted on the base portion 2 and is disposed to direct combustion flames axially upwardly within the cylindrical housing body 3. The burner 10 may be of any well-known structure utilizing liquid or gaseous fuel which may be supplied thereto through a conventional supply line 11. The burner 10 does not, in and of itself, comprise the instant invention. Hence, for the sake of brevity, further showing and description thereof is omitted.

A rigid fluid conduit, indicated generally at 12, is formed to provide interconnected outer, intermediate, and innermost coils 13, 14 and 15 respectively, within the interior of the housing body 3. The coils 13–15 are helically wound, the outermost coil 13 being of substantially greater axial length than the second or intermediate coil 14 and innermost coil 15. With reference particularly to FIG. 1, it will be seen that the convolutions of the outermost coil 13 are in closely wound abutting engagement with each other, each convolution of the coil 13, except for the lowermost one thereof, being in superposed engagement with an underlying convolution. In contrast to this arrangement, the convolutions of the coils 14 and 15 are disposed in axially spaced apart relationship. The end of the lowermost convolution of the outermost coil 13 is provided with a fitting such as an elbow 16. The uppermost convolution of the outer coil 13 is connected to the uppermost convolution of the second or intermediate coil 14 by a conduit portion 17. The lowermost convolution of the coil 14 communicates with the lowermost convolution of the innermost coil 15 by a conduit portion 18, and a conduit portion 19 extends from the upper end convolution of the coil 15, downwardly to a point just above the burner 10 where it terminates in a conventional elbow fitting 20. The body 3 and jacket 6 are provided with suitable openings through which extend exterior conduit members 21 and 22 that are screw threaded into the elbow fittings 20 and 16 respectively, the conduit members 21 and 22 being in the nature of conventional pipe having their inner ends screw threaded into the elbow fittings 20 and 16. The pipe 21 is preferably an inlet pipe, the pipe 22 being an outlet pipe. The outermost coil 13 is supported within the housing 1 by a plurality of circumferentially spaced vertically extending legs 23 that are welded or otherwise rigidly secured to convolutions of the coil 13 and which have lower ends that engage the base portion 2. The coils 14 and 15 are supported in the upper end portion of the coil 13 by the rigidity of the material of the fluid conduit 12, including its interconnecting portions 17 and 18.

A generally horizontally disposed reticulate baffle 24 is disposed within the interior of the coil 13 and is provided with a plurality of circumferentially spaced mounting straps 25 that are welded or otherwise rigidly secured to the baffle 24 and extend upwardly therefrom outwardly of the intermediate coil 14. At their upper ends, the straps 25 are formed to provide inwardly projecting hook portions 26 that have hooking engagement with the upper end of the intermediate coil 14 to support the baffle 24 in underlying engagement with the lower ends of the coils 14 and 15. In the embodiment illustrated, the baffle 24 is in the nature of expanded metal such as stainless steel, and is circular in outline so as to be only slightly less in diameter than the inner diameter of the outer coil 13. At one portion of its marginal edge, the baffle is notched to receive the vertically extending portion 19 of the fluid conduit 12. The baffle 24 may, if desired, be made from mesh screen or of perforated metal sheet so as to permit flow of gases of combustion therethrough.

A second baffle 27 is disposed at the upper end of the outermost coil 13 and in axial alignment with the coils 13-15 and baffle 24. The second baffle 27 is imperforate and is preferably made from suitable material such as stainless steel. As shown, the baffle 27 is of smaller diameter than that of the baffle 24, preferably being equivalent to the outer diameter of the coil 14. The baffle 27 is welded or otherwise rigidly secured to the central portion of a cross bar 28 that is disposed in overlying engagement with the upper end of the outer coil 13. The opposite end portions of the cross bar 28 are upturned to provide ears 29 that are releasably secured to brackets 30 by means of nut equipped screws 31. The brackets 30 are welded or otherwise rigidly secured to diametrically opposite portions of the cylindrical housing body 3. The cross bar 28 not only supports the baffle 27, but serves as a hold-down member for the coil assembly.

The reticulate baffle 24 cooperates with the lower end portion of the outer coil 13 to define a combustion chamber 32. During operation of the burner 10, flames from the burner mount upwardly toward the baffle 24 and are deterred, at least partially, from passing therethrough. Some of the flame does come through the baffle to heat the lower portions of the inner coils 14 and 15, but most of the flame is spread radially outwardly to impinge on the lower portion of the outer coil 13. The baffle 24 become intensely heated, and radiates its heat both downwardly and upwardly. By retarding passage of the gases of combustion upwardly to the upper part of the coil assembly, a more thorough combustion of the fuel within the combustion chamber 32 is obtained than heretofore. It has been found that, with the use of the baffle 24, a reduction from normally 500 parts per million of carbon monoxide to 10 parts per million has been achieved.

The imperforate baffle 27 serves as a reflector to radiate heat from the gases of combustion downwardly against the inner coils 14 and 15, thus extracting additional heat from the gases of combustion, so that the temperature of the gases passing upwardly through the opening 7 is considerably reduced.

When it is desired to remove the fluid conduit 12 from the housing 1, it is only necessary to disconnect the pipes 21 and 22 from their respective fittings 20 and 16, remove the upper end member 4 and the cross bar 28, after which the entire fluid conduit 12 including its coils 13–15 and the baffle 24 may be lifted upwardly from the interior of the housing. To reassemble the heater, the reverse procedure is followed.

While a commercial form of hot water heater is shown and described, it will be understood that the same is capable of modification without departure from the spirit and scope of the invention, as defined in the claims.

What is claimed is:

1. A water heater comprising:

a. a housing including a base portion, a cylindrical body portion, and an upper end member defining an opening for removal of gases of combustion;

b. a burner disposed at said base portion and disposed to direct a combustion flame upwardly in said housing;

c. a rigid fluid conduit in said housing;

d. means for supporting said conduit above the level of said burner;

e. said conduit being formed to provide an interconnected plurality of concentric helical coils including an outer coil of relatively long axial length and an inner second coil of relatively shorter axial length within said outer coil, said second coil having an upper end disposed near the upper end of said outer coil;

f. a generally horizontally disposed reticulate baffle having a diameter slightly less than the inner diameter of said outer coil;

g. and means for supporting said baffle within said outer coil at the lower end of said second coil;

h. said baffle and the lower end portion of said outer coil cooperating with said burner to define a combustion chamber, said baffle being operative to permit flow of gases of combustion upwardly therethrough while retaining the greater portion of the burner flame within the combustion chamber.

2. The water heater defined in claim 1 in which said outer coil comprises convolutions each of which is disposed in superposed engagement with an adjacent convolution, said second coil having convolutions in axially spaced apart relationship.

3. The water heater defined in claim 2 in which said plurality of coils includes a third coil disposed radially inwardly of said second coil and having convolutions in axially spaced relationship.

4. The water heater defined in claim 3 in which said fluid conduit has opposite ends adjacent the lower end of said outer coil, characterized by fittings on said opposite ends within said housing, said housing having openings for reception of exterior conduit members adapted to be releasably attached to said fittings.

5. The water heater defined in claim 1 in which said means for supporting said conduit comprises a plurality of vertically extending legs secured to said outer coil in circumferentially spaced relationship and having lower ends engaging said base.

6. The water heater defined in claim 5 in which said means for supporting the baffle comprises a plurality of circumferentially spaced straps having lower ends secured to said reticulate baffle and upper end portions providing hooks in overlying engagement with the upper end of said second coil.

7. The water heater defined in claim 5, characterized by an imperforate second baffle having a diameter substantially equal to that of said second coil, and mounting means for releasably mounting said second baffle at the upper end of said outer coil and substantially in axial alignment therewith.

8. The water heater defined in claim 7 in which said mounting means comprises a pair of circumferentially spaced brackets secured to said housing in closely spaced relation to the upper end thereof, and a cross bar having an intermediate portion secured to said second baffle and opposite end portions each releasably secured to a different one of said brackets, said cross bar being disposed in overlying engagement with the upper end of said outer coil.

9. The water heater defined in claim 1 in which said reticulate baffle comprises a sheet of expanded metal.

* * * * *